United States Patent [19]

Plasser et al.

[11] 3,976,142

[45] Aug. 24, 1976

[54] BALLAST TREATING APPARATUS

[75] Inventors: Franz Plasser; Josef Theurer, both of Vienna; Karl Fölser, Linz-Urfahr, all of Austria

[73] Assignee: Franz Plasser Bahnbaumaschinen-Industrie Gesellschaft m.b.H., Vienna, Austria

[22] Filed: Dec. 10, 1970

[21] Appl. No.: 96,773

[30] Foreign Application Priority Data

Dec. 18, 1969 Austria ..... 111774/69

[52] U.S. Cl. ..... 171/16; 104/2

[51] Int. Cl.[2] ..... E01B 27/00

[58] Field of Search ..... 104/2; 37/107; 171/16, 171/1

[56] References Cited

UNITED STATES PATENTS

| | | | |
|---|---|---|---|
| 1,793,389 | 2/1931 | Elmer | 171/16 |
| 2,142,208 | 1/1939 | Protzeller | 171/1 |
| 2,775,438 | 12/1956 | Bach et al. | 171/16 |
| 2,791,410 | 5/1957 | Allemann | 171/16 |

FOREIGN PATENTS OR APPLICATIONS

| | | | |
|---|---|---|---|
| 677,923 | 8/1952 | United Kingdom | 171/16 |

*Primary Examiner*—Russell R. Kinsey
*Attorney, Agent, or Firm*—Kurt Kelman

[57] ABSTRACT

In a ballast cleaning apparatus, wherein ballast is removed from underneath a track section, cleaned and returned, clean ballast is stored so that additional amounts of clean ballast may be selectively delivered under the track/or to the cribs.

16 Claims, 4 Drawing Figures

INVENTORS
FRANZ PLASSER
JOSEF THEURER
KARL FOLSER
BY Kurt Kelman
AGENT

INVENTORS
FRANZ PLASSER
JOSEF THEURER
BY KARL FOLSER
Kurt Kelman
AGENT

BALLAST TREATING APPARATUS

The present invention relates to improvements in an apparatus for treating ballast, wherein the apparatus moves on a track including rails fixed to ties resting on a ballast bed and defining cribs therebetween. As the apparatus moves along the track, successive sections of the track are lifted, ballast is removed from the ballast bed underneath the lifted track section, the removed ballast is cleaned, and the clean ballast is returned to the ballast bed, the ballast being conveyed from a removal station to a cleaning station and from the cleaning station to a return station at the ballast bed in a conveying path.

It is well known that, when a heavily encrusted and very dirty ballast bed is renewed in such an operation, several car loads of rubble may have to be taken away over a track section length of no more than ten to twenty yards. Even so, the remaining clean ballast often suffices to refill the bed, which is apparently due to the fact that the clean ballast takes up a larger volume than the compacted dirty ballast in the old bed.

On the other hand, some of the old track sections rest on too little ballast so that, while there is relatively little rubble, not enough clean ballast is recovered to produce a satisfactory ballast bed for the renewed track. This has required an additional supply of ballast to such renewed track sections, which has made these track sections relatively unstable and ill equipped to support train traffic thereover before they were properly stabilized and fixed in position.

Other track sections again produce an excess amount of clean ballast which must be removed separately or together with the rubble, either procedure being highly uneconomical. Furthermore, the ballast conveying circuit in conventional methods and apparatus caused a gap at the beginning and the end of the cleaning stage so that a short section of the ballast bed had to be manually filled with clean ballast.

It is the primary object of this invention to overcome these and other disadvantages, which the invention accomplishes by selectively storing and adding stored clean ballast to the returning clean ballast between the cleaning and return stations. A selected amount of the clean ballast may be returned to the ballast bed underneath the lifted track section and/or to the ballast bed in successive cribs. The lifted track section is then repositioned on the ballast bed.

Excess amounts of the removed and cleaned ballast are stored and stored clean ballast is selectively added to the returning clean ballast. If desired, this may be supplemented by delivering to a storing station for storage with the clean ballast additional clean ballast.

It is advantageous to level and compact the clean ballast returned to the ballast bed underneath the lifted track section to provide a desired grade for the track section, and then to lower the track section to rest on the leveled and compacted ballast. Additionally, clean ballast may be delivered to the ballast bed in successive cribs of the lowered track.

With the storage of clean ballast according to the present invention, there is always sufficient ballast available for the renewed track bed whereon the track may be positioned at the desired grade and in alignment so that it may take train traffic at speeds from about 35 to 50 miles/hour even before it is permanently fixed in position by subsequent deep tamping. The storage of clean ballast makes it possible not only to refill the ballast bed at the return station where the dirty ballast has been removed but also to fill the cribs behind that station in the repositioned track section in the same operation, which further holds the repositioned track section in position.

In those track sections where relatively large amounts of ballast are removed and/or the removed ballast is relatively clean, it will be possible to store excess amounts of cleaned ballast not needed for the renewed ballast bed. Such stored excess amounts of clean ballast will then be used when needed in other track sections.

The apparatus of this invention comprises a frame having front and rear running gears moving on the track rails. Means are mounted on the frame between the running gears for lifting a section of the track, for removing ballast underneath the lifted track section from the ballast bed, and for cleaning the removed ballast. Conveyor means is provided for conveying the removed ballast from the ballast removing means to the ballast cleaning means, and for conveying clean ballast from the ballast cleaning means to the ballast bed in a conveying path. A ballast storage means in the conveying path between the ballast cleaning means and the ballast bed selectively stores and discharges selected portions of the clean ballast to the ballast bed.

The above and other objects, advantages and features of the present invention will become more apparent from the following detailed description of a now preferred embodiment thereof, taken in conjunction with the accompanying drawing wherein FIG. 1 is a side view, partially in section, of a mobile ballast treating apparatus according to this invetion;

Figure 1:
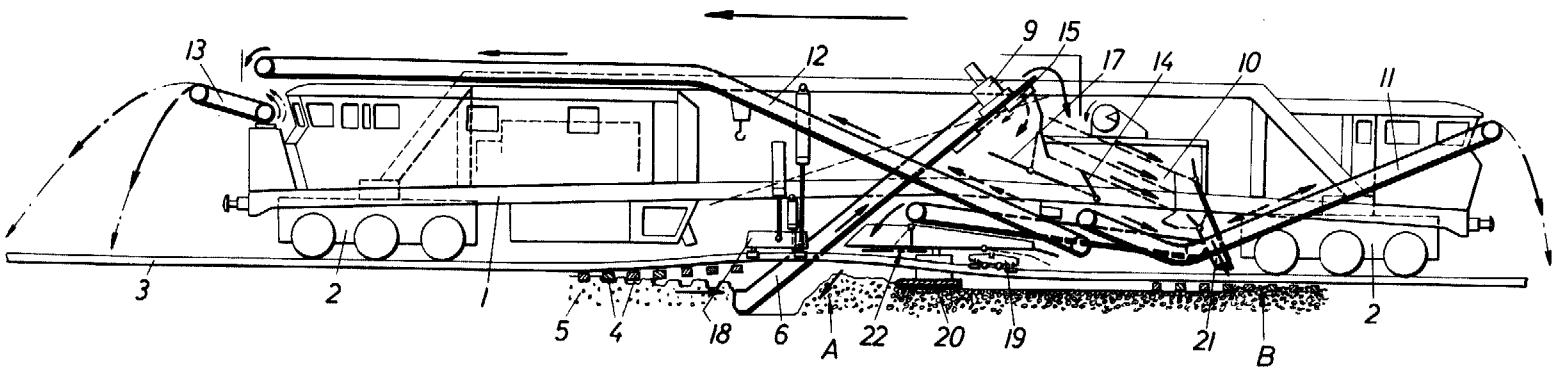

Referring now to the drawing, the apparatus is shown to include an elongated frame 1 having front and rear running gears 2, 2 moving over a track which includes rails 3 fixed to ties 4 resting on ballast 5. In a conventional manner, a bucket conveyor 6 is mounted on the apparatus frame for removing ballast from underneath the track. The upper ends 7, 7 of the bucket conveyor are mounted for pivoting the conveyor laterally, i.e. transversely of the track, as well as vertically. In the illustrated embodiment, the bucket conveyor moves through a triangular path determined by a pair of guide rolls 8, 8 and a driven roll 9 over which the conveyor chain is trained. Obviously, other ballast removing means may be used, and the invention is not concerned with the structure of such means.

As is also conventional, the upwardly moving ballast removed from underneath the track is conveyed to a ballast cleaning means illustrated herein as a swinging, vibratory screen or sieve 10 which is mounted on frame 1 downwardly inclined for gravity feeding the cleaned ballast and the dirt separated therefrom to subsequent conveyor means. Fines and dirt are separated from the ballast on screen 10 by falling through the apertures in the screen. An endless conveyor 11 receives the fines and dirt and, depending on the direction of the movement of the conveyor, delivers the same rearwardly (seen in the working direction of the apparatus indicated by the horizontal arrow) or forwardly over endless conveyor 12 and a short endless conveyor 13. Suitable wagons are coupled to the apparatus at the rearward or forward end of the apparatus to receive the fines and dirt.

The path of the conveyed material is determined by a series of adjustable ballast discharge or guide means including the following:

Pivotal baffles 14 and 17 may be moved into selected positions indicated in full and broken lines, respectively, by remote controlled drives 14' and 17'. Furthermore, the bottom of the support of the bucket conveyor 6 has a discharge port which may be selectively opened and closed by a sliding door 15 movable by hydraulic motor 16. When the port is opened, the bucket conveyor will not deliver the removed ballast to the cleaning screen but discharge it directly to conveyor 11 or 12, depending on the pivotal position of baffles 14 and 17.

As will be noted in the drawing, the section of the track, under which ballast is removed by bucket conveyor 6, is lifted by a pair of track lifting means 18 and 19 of generally conventional structure, the track jack 18 being mounted on frame 1 substantially in vertical alignment with the transversely extending stringer of bucket conveyor 6 while the track jack 19 is mounted behind it (in the working direction). The illustrated track jacks have pairs of rail gripping rollers 18*a*, 19*a*, respectively, which may be laterally moved to enable the track to be lined, the lateral movement being effected by centrally mounted hydraulic motor 18' (see FIG. 4). Ballast leveling means comprising a preferably vibratory surface compacter 20 is mounted between the two track jacks to level and tamp the ballast returned to the track at station A. In this manner, the cleaned ballast will provide the proper grade for the repositioned and lined track. The vibration frequency of the surface compactor may be adjustable in dependence on the moving speed of the apparatus so that, regardless of this speed, the ballast will be compacted uniformly. To maintain the track in its repositioned and lined condition, clean ballast is also conveyed to the cribs of the repositioned track station B by means of chute 21 receiving clean ballast from screen 10 in a manner more fully described hereinafter. This additional ballast fill provides sufficient ballast for the subsequent tamping operation wherein ballast is tamped under the ties for fixing the track in position.

Figure 2:
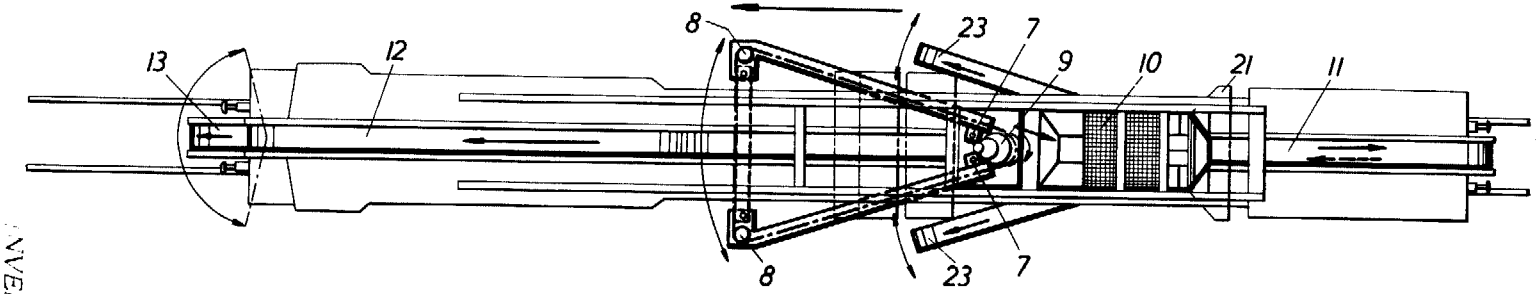
FIG. 2 is a top view of FIG. 1.

In accordance with the present invention, the conveyance of clean ballast in selected amounts and to selected track sections is adapted to need by providing a ballast storage means in the conveyor circuit, the preferred storage means being a bin through which ballast may pass after temporary storage therein. The illustrated storage means is a bin 22 whose open top is positioned below the discharge ends of a pair of elongated endless conveyor bands 23 extending in the direction of track elongation. The conveyor bands 23 receive cleaned ballast from screen 10 in a manner to be described hereinafter and, as shown in FIG. 2, they are pivotally mounted on frame 1 for lateral movement of their discharge ends so that they may feed clean ballast selectively into storage bin 22 or directly to the track at point A, pivoting of the discharge ends enabling the ballast to be distributed uniformly as it is discharged. As will be noted from FIG. 4, such uniform discharge of the ballast to the track is also assured from the storage bin which extends at least the entire width of the track, i.e. the length of the ties 4, but preferably extends transversely over the width of the entire ballast bed.

The open storage bin 22 is divided into two storage chambers 25 and 26 by a hinged wall 24 which may be selectively pivoted into positions indicated by full and broken lines by a preferably remote controlled hydraulic motor 24'. The front storage chamber 25, which is vertically aligned with the ballast filling station A, has a slidably adjustable bottom 27 for discharging selected amounts of ballast, adjusted positions of the bottom 27 being indicated in full and broken lines, respectively, while the rear storage chamber 26 has a trap door 28 extending rearwardly and being pivotal into selected positions also shown in full and broken lines, respectively, in FIG. 3. The entire bottom of storage bin 22 is downwardly inclined in the forward direction so that, provided the trap door 28 is closed, ballast in the bin is gravity fed towards filling station A.

Figure 3:
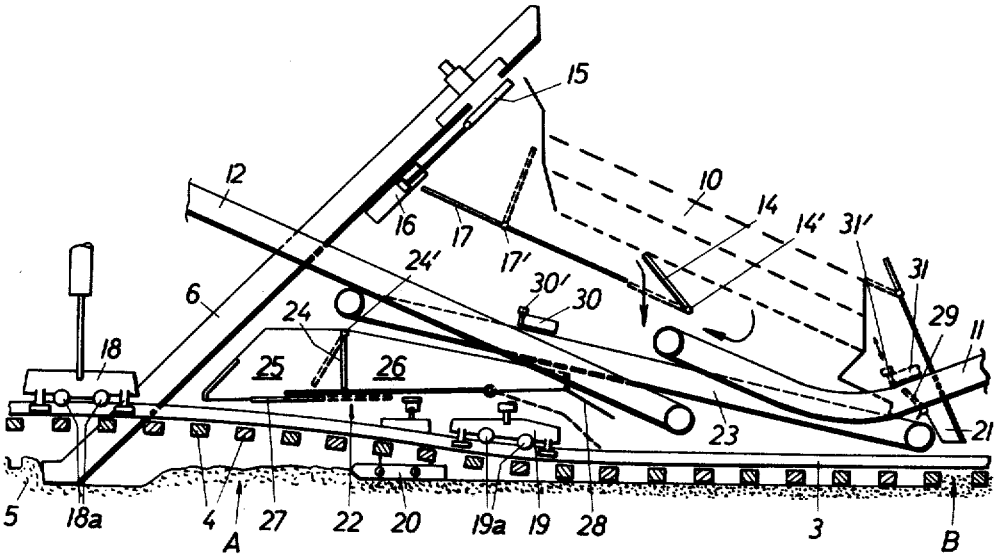
FIG. 3 is an enlarged side view of the central part of the apparatus of FIG. 1, showing the ballast storage means of the invention.

The apparatus operates as follows:

If the amount of clean ballast at stations A and B, i.e. underneath the lifted track section and the cribs of the repositioned track section, respectively, corresponds to the amount of cleaned ballast coming from screen 10, the sliding bottom 27 is opened fully into the retracted position shown in broken lines in FIG. 3 and the wall 24 is closed into the position shown in full lines therein. This assures the full amount of cleaned ballast delivered to the open bin 22 by conveyor bands 23 to be returned to station A, the feeding of cleaned ballast from screen 10 to conveyor bands 23 being regulated by pivotal baffle 29 which may be selectively adjusted to direct the ballast to the conveyor bands 23 or the chute 21, or which may be pivoted to an intermediate position wherein portions of the cleaned ballast are directed to the conveyor bands 23 while another portion thereof will fall through chute 21 into cribs of the repositioned track.

Figure 4:
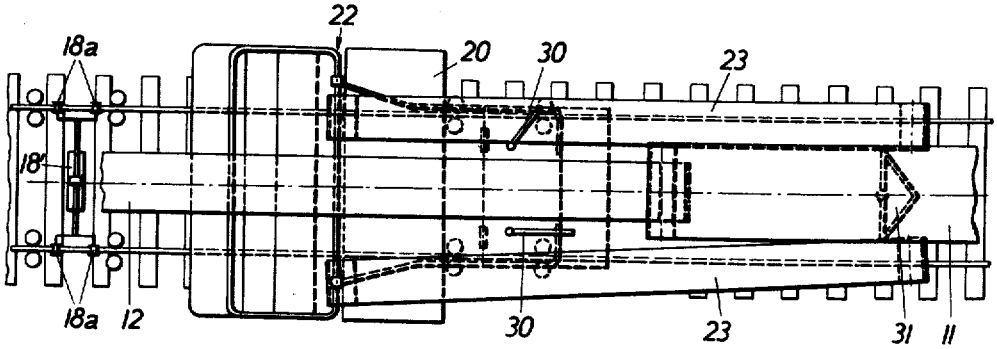
FIG. 4 is a top view of FIG. 3, with the ballast cleaning screen removed.

If the screen 10 delivers more cleaned ballast than is needed at stations A and B, a selected amount of the cleaned ballast may be deflected into rear storage chamber 26 of bin 22 by suitably pivoting the baffles 30 into selected positions across the conveyor bands 23 so that some or all of the conveyed ballast is prevented from passing the baffles towards the discharge ends of the conveyor bands and is forced to drop into storage chamber 26. FIG. 4 illustrates one of the baffles 30 in a blocking position wherein all of the ballast is deflected into storage chamber 26 while the other baffle 30 is pivoted completely out of the way to permit all of the ballast to reach the discharge end of the conveyor band. As in the case of all the guide or baffle means selectively directing the cleaned ballast along the conveyor means, the baffles 30 are remote controlled by hydraulic drives 30'.

On the other hand, if the conveyor bands 23 deliver too little cleaned ballast to satisfy the requirements, clean ballast stored in storage bin 22 is mixed with the conveyed ballast to obtain the desired amounts. At station A, this is accomplished by opening the hinged wall 24 into the position indicated in broken lines in FIG. 3 to gravity feed clean ballast from reserve chamber 26 into the forward chamber 25 of the storage bin. If additional ballast is needed in the cribs of the repositioned track, trap door 28 of the reserve storage chamber 26 is lowered into the position shown in broken lines so that stored ballast falls from the chamber 26 into a crib therebelow.

Further regulation of the ballast feed to station A is possible by adjusting the position of slidable bottom 27 so that selected amounts of ballast are discharged through the opening in the bottom of chamber 25.

In case the screen 10 delivers too little or no cleaned ballast, which will happen when the removed ballast is so dirty or comminuted that all of it falls through the screen openings and is taken away by conveyor 12, the conveyor band 11 may be used to deliver clean ballast to conveyor bands 23. As shown by the arrows in FIG. 2, the direction of movement of conveyor 11 is reversible so that it may be used selectively to carry away fines and dirt discharged through screen 10 or to deliver clean ballast to the apparatus. When clean ballast is to be delivered by conveyor band 11 to conveyor bands 23, 23, a wedge-shaped baffle 31 is lowered into position on the conveyor band 11 to direct clean ballast off the conveyor 11 to the conveyors 23, 23, this baffle again being remote controlled by drive 31'.

Obviously, many variations and modifications of the described and illustrated structure will occur to those skilled in the art without departing from the spirit and scope of the present invention, particularly after benefiting from the teaching thereof. Thus, the ballast storage means may take many forms other than that herein shown, and it may be arranged in the ballast conveyor circuit at any point thereof, rather than at its ends, as described. It is within the purview of this invention, to couple a transport car carrying clean ballast to the illustrated apparatus and to provide a conveyor (such as 11) for delivering additional clean ballast to the ballast conveyor circuit and the ballast storage means forming a part thereof. It may also be useful, for instance, to provide the storage bin 22 with a vibrating bottom operating like a vibratory chute, a common vibrating drive being provided for the compactor 20 and the vibrating bottom of the storage bin. The scope of the invention is defined by the appended claims.

We claim:

1. An apparatus for treating ballast and adapted to move on a track including rails fixed to ties resting on a ballast bed and defining cribs therebetween, comprising 1. a frame moving on the track rails;
2. means mounted on the frame for lifting a section of the track;
3. a ballast removing chain means mounted on the frame and extending transversely underneath the track section for removing ballast from the ballast bed under the lifted track section;
4. a ballast cleaning screen mounted on the frame and separating the removed ballast into cleaned ballast and rubble;
5. conveyor means for conveying the removed ballast from the ballast removing chain means to the ballast cleaning screen, for removing the rubble, and for conveying the cleaned ballast from the ballast cleaning screen to underneath the lifted track section in a conveying path, the conveyor means comprising a conveyor band having a discharge end immediately adjacent the ballast removing chain means for uniformly distributing the ballast underneath the lifted track section, the conveyor band being pivotal in a plane substantially parallel to the plane of the track; and
6. ballast storage means storing clean ballast, the storage means being arranged in said conveying path under the conveyor band discharge end between the ballast cleaning screen and the lifted track section and receiving the conveyed, cleaned ballast for selectively storing and depositing selected portions of the clean and cleaned ballast underneath the lifted track section.

2. The apparatus of claim 1, further comprising means for leveling the deposited ballast underneath the lifted track section.

3. The apparatus of claim 1, further comprising means for positioning the track section on the deposited ballast.

4. The apparatus of claim 1, wherein the ballast storage means has adjustable ballast discharge means for discharging selected amounts of ballast.

5. The apparatus of claim 1, wherein the ballast storage means comprises a downwardly inclined bottom discharging stored ballast by gravity.

6. The apparatus of claim 1, wherein the ballast storage means has ballast discharge means extending the width of the track.

7. The apparatus of claim 6, wherein the discharge means extends the width of the entire ballast bed.

8. The apparatus of claim 1, wherein the ballast storage means has two storage chambers, each chamber having adjustable ballast discharge means.

9. The apparatus of claim 1, further comprising means in the conveying path for depositing selected portions of the clean and cleaned ballast in successive cribs remote from the lifted track section.

10. The apparatus of claim 1, wherein the lifting means comprises a first track lifting means vertically aligned with the ballast removing chain means, and a second track lifting means spaced therefrom in the direction of track elongation.

11. The apparatus of claim 10, wherein the second track lifting means is combined with means for laterally moving the track.

12. An apparatus for treating ballast and adapted to move on a track including rails fixed to ties resting on a ballast bed and defining cribs therebetween, comprising 1. a frame moving on the track rails;
2. means mounted on the frame for lifting a section of the track;
3. a ballast removing chain means mounted on the frame and extending transversely underneath the track section for removing ballast from the ballast bed under the lifted track section;
4. a ballast cleaning screen mounted on the frame and separating the removed ballast into cleaned ballast and rubble;
5. conveyor means for conveying the removed ballast from the ballast removing chain means to the ballast cleaning screen, for removing the rubble, and for conveying the cleaned ballast from the ballast cleaning screen to underneath the lifted track section in a conveying path, the conveyor means comprising a conveyor band receiving cleaned ballast from the ballast cleaning screen and having a ballast discharge end; and
6. ballast storage means storing clean ballast, the storage means being arranged in said conveying path under the conveyor band discharge end between the ballast cleaning screen and the lifted track section and receiving the conveyed, cleaned ballast for selectively storing and depositing selected portions of the clean and cleaned ballast underneath the lifted track section, the ballast storage means having a bottom which may be selectively opened and closed.

13. The apparatus of claim 12, further comprising a slidable door for selectively opening and closing the bottom of the ballast storage means.

14. An apparatus for treating ballast and adapted to move on a track including rails fixed to ties resting on a ballast bed and defining cribs therebetween, comprising 1. a frame moving on the track rails;
2. means mounted on the frame for lifting a section of the track;
3. a ballast removing chain means mounted on the frame and extending transversely underneath the track section for removing ballast from the ballast bed under the lifted track section;
4. a ballast cleaning screen mounted on the frame and separating the removed ballast into cleaned ballast and rubble;
5. conveyor means for conveying the removed ballast from the ballast removing chain means to the ballast cleaning scren, for removing the rubble, and for conveying the cleaned ballast from the ballast cleaning screen to underneath the lifted track section in a conveying path; and
6. ballast storage means storing clean ballast, the storage means being arranged in said conveying path between the ballast cleaning screen and the lifted track section and receiving the conveyed, cleaned ballast for selectively storing and depositing selected portions of the clean and cleaned ballast underneath the lifted track section, the ballast storage means having two storage chambers, a first one of the storage chambers receiving the cleaned ballast from the ballast cleaning screen, a second one of the chambers storing and selectively discharging clean ballast, and means for selectively moving portions of the clean and cleaned ballast between said chambers.

15. The apparatus of claim 14, further comprising remote controllable means associated with the conveyor means for guiding cleaned ballast into the first storage chamber.

16. An apparatus for treating ballast and adapted to move on a track including rails fixed to ties resting on a ballast bed and defining cribs therebetween, comprising 1. a frame moving on the track rails;
2. means mounted on the frame for lifting a section of the track;
3. a ballast removing chain means mounted on the frame and extending transversely underneath the track section for removing ballast from the ballast bed under the lifted track section;
4. a ballast cleaning screen mounted on the frame and separating the removed ballast into cleaned ballast and rubble;
5. conveyor means for conveying the removed ballast from the ballast removing chain means to the ballast cleaning screen, for removing the rubble, and for conveying the cleaned ballast from the ballast cleaning screen to underneath the lifted track section, the conveyor means comprising a conveyor band having a discharge end immediately adjacent the ballast removing chain means for uniformly distributing ballast underneath the lifted track section, the conveyor band being pivotal in a plane substantially parallel to the plane of the track; and
6. ballast storage means storing clean ballast, the storage means being arranged between the ballast cleaning screen and the lifted track section and receiving the cleaned ballast for selectively storing the same and permitting selected portions of the clean and cleaned ballast to be deposited underneath the lifted track section.

* * * * *